US008480069B2

(12) United States Patent
Shibasaki et al.

(10) Patent No.: US 8,480,069 B2
(45) Date of Patent: Jul. 9, 2013

(54) SHEET PROCESSING APPARATUS AND IMAGE FORMING SYSTEM

(75) Inventors: Yuusuke Shibasaki, Kanagawa (JP); Hitoshi Hattori, Tokyo (JP); Takashi Saito, Kanagawa (JP); Naoyuki Ishikawa, Kanagawa (JP); Akihiro Musha, Kanagawa (JP); Shuuya Nagasako, Kanagawa (JP); Naohiro Kikkawa, Kanagawa (JP); Hidetoshi Kojima, Miyagi (JP); Naoki Oikawa, Miyagi (JP); Go Aiba, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 28 days.

(21) Appl. No.: 13/249,783

(22) Filed: Sep. 30, 2011

(65) Prior Publication Data

US 2012/0083400 A1 Apr. 5, 2012

(30) Foreign Application Priority Data

Oct. 1, 2010 (JP) ..... 2010-223794

(51) Int. Cl.
*B65H 37/04* (2006.01)
*B31F 1/08* (2006.01)

(52) U.S. Cl.
USPC ..... 270/37; 270/45; 270/58.07; 270/58.08; 270/58.09

(58) Field of Classification Search
USPC . 270/32, 37, 45, 58.07, 58.08, 58.09; 493/59, 493/355, 396, 397, 240, 242
See application file for complete search history.

(56) References Cited

U.S. PATENT DOCUMENTS

| | | | | |
|---|---|---|---|---|
| 5,709,376 | A * | 1/1998 | Ushirogata | 270/58.11 |
| 6,006,065 | A * | 12/1999 | Seki | 399/407 |
| 6,065,383 | A * | 5/2000 | Takaishi et al. | 83/368 |
| 7,597,311 | B2 * | 10/2009 | Kawata et al. | 270/37 |
| 7,740,238 | B2 * | 6/2010 | Iijima et al. | 270/37 |
| 2009/0062096 | A1 * | 3/2009 | Sasahara | 493/396 |
| 2009/0121408 | A1 * | 5/2009 | Awano | 270/37 |
| 2009/0258774 | A1 * | 10/2009 | Suzuki et al. | 493/442 |
| 2010/0207314 | A1 | 8/2010 | Hattori et al. | |
| 2011/0076081 | A1 | 3/2011 | Hattori et al. | |
| 2011/0130260 | A1 | 6/2011 | Kikkawa et al. | |

FOREIGN PATENT DOCUMENTS

| | | | |
|---|---|---|---|
| JP | 60-258065 | A | 12/1985 |
| JP | 2001010759 | A | 1/2001 |
| JP | 2009051667 | A | 3/2009 |
| JP | 2011105466 | A | 6/2011 |

* cited by examiner

*Primary Examiner* — Leslie A Nicholson, III
(74) *Attorney, Agent, or Firm* — Harness, Dickey & Pierce, P.L.C.

(57) ABSTRACT

A sheet processing apparatus includes: a correcting unit that corrects alignment of a sheet; a post-processing unit that performs post-processing on the sheet after the correcting unit corrects the alignment of the sheet; and a creasing unit that forms a crease on the sheet after the correcting unit corrects the alignment of the sheet.

9 Claims, 21 Drawing Sheets

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2010-223794 filed in Japan on Oct. 1, 2010.

BACKGROUND OF THE INVENTION

1. Field of the Invention

The present invention relates to a sheet processing apparatus and an image forming system and, more specifically, to a sheet processing apparatus that includes a creasing unit and an image forming system that includes the sheet processing apparatus and an image forming apparatus, such as a copying machine, printer, facsimile, or digital multifunction peripheral that has the functions of a copying machine, printer, and facsimile in combination.

2. Description of the Related Art

Conventionally, center-folding or center-folded bookbinding is performed to a plurality of sheets, recording sheets, transfer sheets, or sheet-like recording members such as film-like members (hereafter, referred to as "sheets" in this specification) discharged from an image forming apparatus in such a way that the discharged sheets are combined together in a sheaf and bound together at the center section thereof, and the sheaf of center-bound sheets is folded in two at the center section. If whole of the sheets in a sheaf are folded together, the folded area of the outer sheet in the sheaf is stretched more than that of the inner sheet. Because an image area, on which the image is formed, on the folded area of the outer sheet is stretched, damage, such as toner coming off, may occur on the image area. The same phenomenon occurs in other folding processes such as Z-folding or tri-folding even when a binding operation is not performed. A sheet in a sheaf may be insufficiently folded due to the thickness of the sheaf.

A creasing device, called a creaser, is already known. Before a folding process, such as a process for folding a sheaf of sheets in two, is performed, the creasing device forms a crease in advance on an area of the sheet that is to be folded so that even the outer sheet can be easily folded, preventing toner from coming off the sheet. In such a creasing device, a crease is formed on a sheet in a direction perpendicular to the conveying direction by using a unit, such as a roller, laser, or creasing blade for pressing.

Japanese Patent Application Laid-open No. 2009-051667 describes the invention of a creasing device. The object of this invention is to improve the shape of a finished sheet by using a simple configuration. The invention is characterized by a creasing device that includes a conveying mechanism that conveys a sheet in a conveying direction; a creasing unit that forms a crease on the sheet; a sensor that detects the tilt of the sheet in the conveying direction; and an aligning mechanism that rotates the creasing unit so as to align the creasing unit with the tilt of the sheet detected by the sensor. In this creasing device, the creasing unit includes a disk-shaped creasing blade that is moved and rotated above the sheet and forms a crease on the sheet.

For a creasing process performed in a conventional manner, a creasing device is used as a single device (as a mechanism); therefore, it is necessary to allow for a space corresponding to the length of a sheet in the conveying direction. Specifically, if a creasing process is performed by a post-processing system, a creasing device is placed between the image forming apparatus and the post-processing (stapling, center-binding, punching, stacking, folding, or the like) apparatus. In this system, a sheet is received by the creasing device, is subjected to a sheet-alignment correction process, such as skew correction, is stopped at a creasing position, is subjected to creasing, and is conveyed downstream in the conveying direction for post-processing. In such a case, because sheet alignment correction and creasing are performed within the creasing device, the creasing device needs a space corresponding to the size of a sheet in the conveying direction, thus the device itself takes a large space. Furthermore, there has been a problem of increase in power consumption because the creasing device needs to have a sheet-alignment correcting mechanism or a position setting mechanism. If different mechanisms are used as a sheet-alignment correcting mechanism and a position setting mechanism in the creasing device and the post-processing apparatus, errors occur during the sheet-alignment correction process and the position setting process in the sheet-alignment correcting mechanism and the position setting mechanism, which results in a problem of uneven accuracy.

SUMMARY OF THE INVENTION

It is an object of the present invention to at least partially solve the problems in the conventional technology.

According to an aspect of the present invention, there is provided a sheet processing apparatus including: a correcting unit that corrects alignment of a sheet; a post-processing unit that performs post-processing on the sheet after the correcting unit corrects the alignment of the sheet; and a creasing unit that forms a crease on the sheet after the correcting unit corrects the alignment of the sheet.

According to another aspect of the present invention, there is provided an image forming system including a sheet processing apparatus and an image forming apparatus. The sheet processing apparatus includes: a correcting unit that corrects alignment of a sheet; a post-processing unit that performs post-processing on the sheet after the correcting unit corrects the alignment of the sheet; and a creasing unit that forms a crease on the sheet after the correcting unit corrects the alignment of the sheet. The image forming apparatus forms an image on the sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
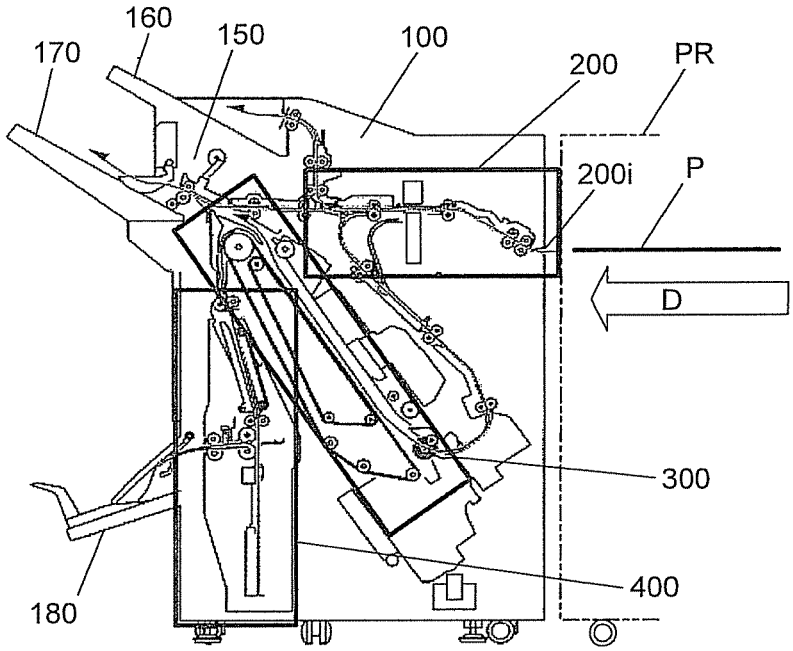
FIG. 1 is a diagram illustrating the schematic configuration of an image forming system, based on which the present embodiment is described.

In the embodiments described later, a post-processing unit corresponds to a punching unit 200, a binding unit 300, and a folding unit 400; a sheet corresponds to the reference symbol P; a sheet processing apparatus corresponds to a sheet post-processing apparatus 100; a creasing unit corresponds to a creasing mechanism 500; a punching unit corresponds to the punching unit 200; a conveying roller pair that is a position setting unit corresponds to a third conveying roller pair 202; a conveying unit corresponds to a second conveying roller pair 201, the third conveying roller pair 202, and a fourth conveying roller pair 203; a control unit corresponds to a CPU 100*a*; a binding unit corresponds to the binding unit 300; a base fence corresponds to a base fence 305 with which the trailing end of a sheet is in contact or a base fence 412 with which the leading end of a sheet is in contact; a position setting unit corresponds to the base fence 305, a pair of pulleys including a drive pulley and a driven pulley, and an endless belt 516 that is stretched between the pulleys; a tray corresponds to a processing tray 304; a moving unit corresponds to a pair of pulleys 515, including the drive pulley and the driven pulley, and the endless belt 516 that is stretched between the pulleys or a moving unit corresponds to a pair of pulleys 410, including a drive pulley and a driven pulley, and an endless belt 411 that is stretched between the pulleys; a folding unit corresponds to the folding unit 400; a tapping unit corresponds to a tapping member 308 or 409; and an image forming apparatus corresponds to the reference symbol PR.

When a crease is formed at the folding position of a sheet that is to be folded on the downstream side, it is necessary to correct the alignment of the sheet, on which creasing is to be performed, and to set the creasing position. The present embodiment is characterized in that a correction process or a process for setting a creasing position is performed by using a unit that has the same configuration as a post-processing unit.

Exemplary embodiments are explained in detail below with reference to the accompanying diagrams.

Overall Configuration

FIG. 1 is a diagram illustrating the schematic configuration of an image forming system, based on which the present embodiment is described. The image forming system primarily includes the image forming apparatus PR that forms an image on a sheet and the sheet processing apparatus that performs a predetermined process, such as punching, aligning, binding, or folding, on the sheet P that is conveyed from the image forming apparatus PR. Here the sheet post-processing apparatus is the sheet post-processing apparatus 100.

The image forming apparatus PR outputs an image data, having been input from a scanner, personal computer (PC), or the like, on a sheet as a visible image. A well-known image forming engine using an electrophotographic system, an inkjet system, or the like, is used in the image forming apparatus PR.

The sheet post-processing apparatus 100 includes functional units such as the punching unit 200, the binding unit 300, and the folding unit 400, which are arranged along the sheet conveying direction. The sheet post-processing apparatus 100 further includes a shifting mechanism 150, a proof tray 160, a shifting tray 170, a stacking tray 180, and the like, which are arranged along the sheet conveying direction. The sheet conveyed from the image forming apparatus PR is received by the sheet post-processing apparatus 100 through a sheet conveyance entrance 200*i* illustrated in FIG. 1. The conveying path is changed according to the processes as necessary. When a punching process is performed, the sheet P is subjected to alignment correction in the punching unit 200 and then conveyed to the punching position where the sheet P is punched and then conveyed again to be discharged. If a binding process is performed, the sheet P is conveyed to the binding unit 300 through the punching unit 200, is subjected to alignment correction on a tray of the binding unit 300, is subjected to a binding process, and then is conveyed again to be discharged. If a folding process is performed, the sheet P is conveyed to the binding unit 300 through the punching unit 200, is subjected to alignment correction on a tray of the binding unit 300, is conveyed to the folding unit 400, is subjected to sheet alignment correction again, is subjected to a folding process, and is then conveyed again to be discharged. These processes may be performed alone or may be performed in combination, for example, a binding process may be performed after a punching process.

Creasing Mechanism

Figure 2:
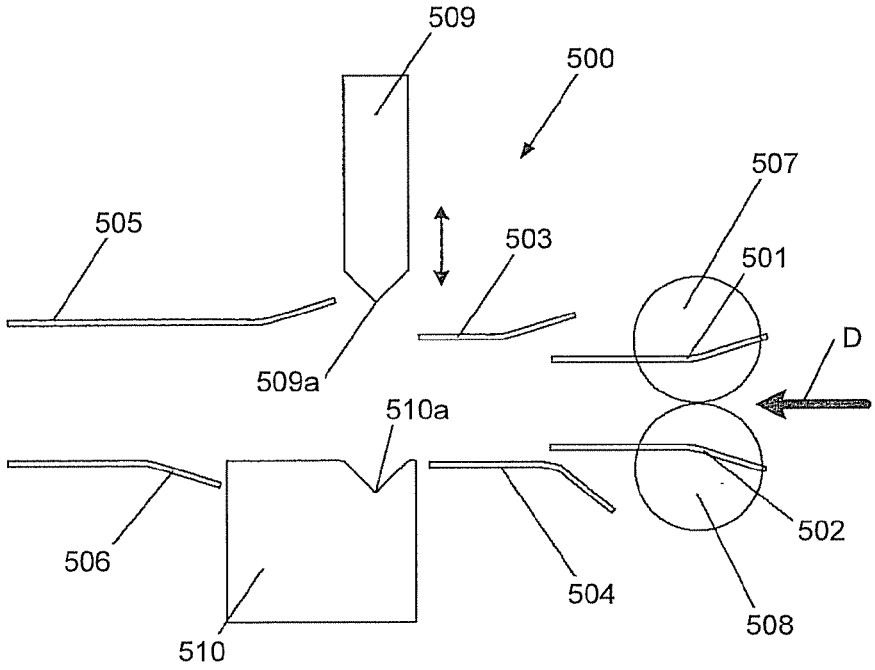
FIG. 2 is an explanatory diagram that illustrates the outline and operation of a creasing mechanism and illustrate a state where creasing is not performed.
Figure 3:
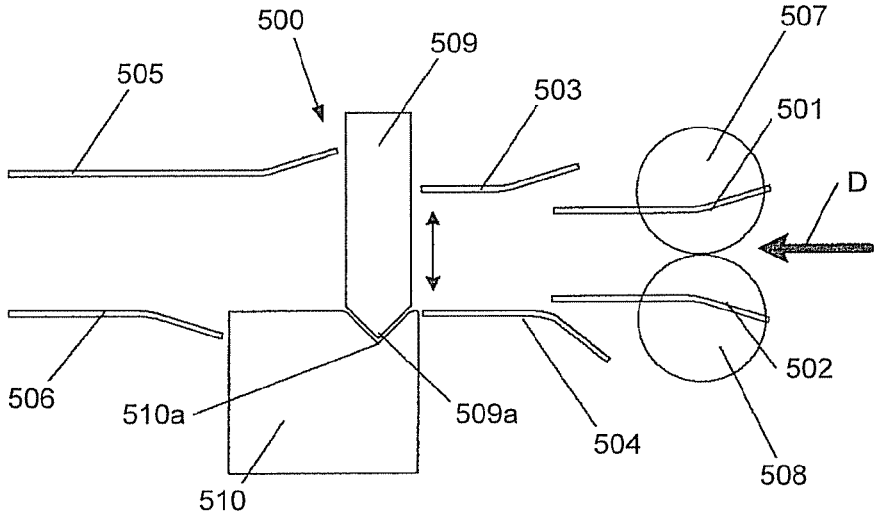
FIG. 3 is an explanatory diagram that illustrates the outline and operation of the creasing mechanism and illustrate a state where creasing is performed.

FIGS. 2 and 3 are explanatory diagrams that illustrate the outline of the creasing mechanism. As illustrated in FIGS. 2 and 3, the creasing mechanism 500 includes a pair of first conveyance guide plates 501, 502, a pair of second conveyance guide plates 503, 504, and a pair of third conveyance guide plates 505, 506 that are arranged in this order from the upstream side to the downstream side in the sheet conveying direction; a pair of first conveying rollers 507, 508 that are arranged at the positions of the first conveyance guide plates 501, 502; a creasing member 509 that is arranged between the second conveyance guide plate 503 and the third conveyance guide plate 505; and a receiving board 510 that is located at a position opposed to the creasing member 509 and between the second conveyance guide plate 504 and the third conveyance guide plate 506. A creasing convex blade 509*a* is formed at an edge of a side of the creasing member 509 opposed to the receiving board 510. The creasing convex blade 509*a* protrudes in a direction perpendicular to the sheet conveying direction. A creasing concave blade 510*a* into which the creasing blade 509*a* can fit is formed on a portion of the receiving board 510 opposed to the creasing blade 509*a*. In the embodiments described later, the creasing mechanism 500 includes a drive mechanism of the creasing member 509.

A crease is formed on the sheet P by the creasing convex blade 509*a* and the creasing concave blade 510*a*. When creasing is performed, the sheet P is conveyed to a position where the sheet P is to be creased (in the direction of an arrow D: the sheet conveying direction) in a gap between the creasing convex blade 509*a* and the creasing concave blade 510*a* while the two blades 509*a*, 510*a* are in a stand-by state that allows conveying of the sheet P, as illustrated in FIG. 2. After the sheet P is stopped at the position where the sheet P is to be creased, the creasing member 509 is moved downward, as illustrated in FIG. 3, and the sheet P is sandwiched between the creasing convex blade 509*a* and the creasing concave blade 510*a*, whereby a crease is formed on the sheet P due to the pressing force between the two blades 509*a*, 510*a*. After the crease is formed, the creasing convex blade 509*a* is returned to the stand-by position so that a space is formed between the two blades 509*a*, 510*a*. Thus, the sheet P can be conveyed and is conveyed downstream in the sheet conveying direction.

An explanation is given, with reference to FIGS. 4 to 14, of a sheet alignment correction mechanism and a position setting mechanism having been embodied in conventional sheet processing apparatuses.

Punching Unit

FIGS. 4 to 7 are explanatory diagrams that illustrate a sheet-alignment correcting mechanism and a position setting mechanism of the punching unit 200 that performs a punching process as post-processing in the sheet post-processing apparatus 100.

Figure 4:
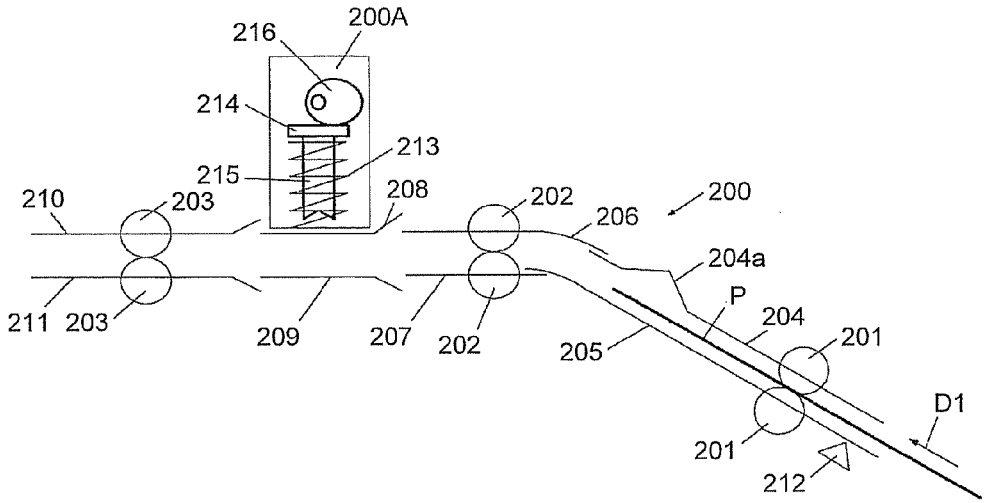
FIG. 4 is an explanatory diagram that illustrates a sheet-alignment correcting mechanism and a position setting mechanism of a punching unit and illustrates a state where a sheet has just been conveyed.
Figure 5:
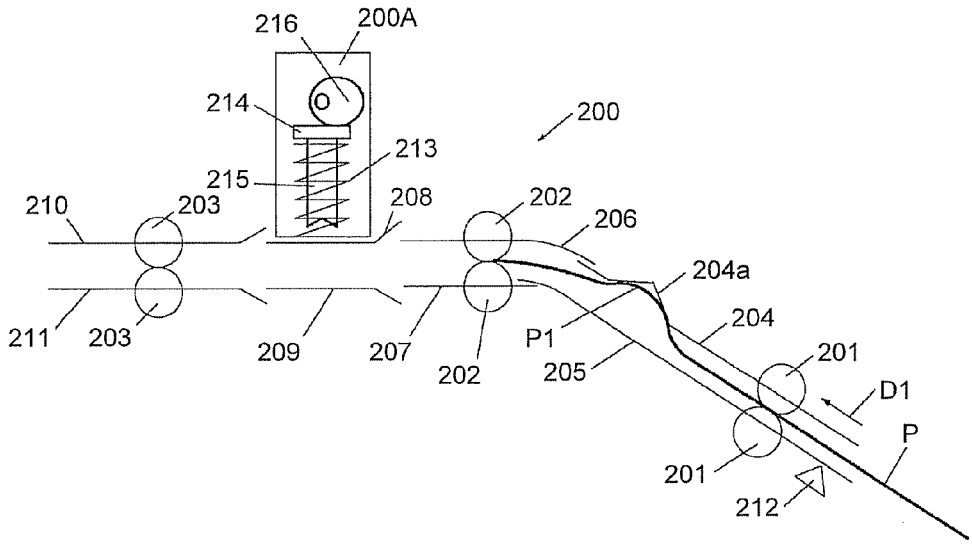
FIG. 5 is an explanatory diagram that illustrates the sheet-alignment correcting mechanism and the position setting mechanism of the punching unit and illustrates a state where the alignment of the sheet is corrected.

FIG. 4 is a diagram illustrating a state where a sheet has just been conveyed to the punching unit 200. As illustrated in FIG. 4, the punching unit 200 includes a pair of second, of third, and of fourth conveying rollers 201, 202, and 203 that are arranged in this order from the upstream side in the sheet conveying direction (the direction of an arrow D1). The punching unit 200 further includes a pair of fourth conveyance guide plates 204 and 205, a pair of fifth conveyance guide plates 206 and 207, a pair of sixth conveyance guide plates 208 and 209, and a pair of seventh conveyance guide plates 210 and 211 through which the sheet P is to be conveyed. Each one of the pair of second conveying rollers 201 is located on one of the pair of fourth conveyance guide plates 204, 205; each one of the pair of third conveying rollers 202 is located on one of the pair of fifth conveyance guide plates 206, 207; and each one of the pair of fourth conveying rollers 203 is located on one of the seventh conveyance guide plates 210, 211. A punching mechanism 200A is located at the position of the pair of sixth conveyance guide plates 208, 209.

The punching mechanism 200A includes a cam 216 and a punching member (puncher) 215 that is a cam follower. The punching mechanism 200A further includes an elastic member 213, such as a spring, that always elastically biases the punching member 215 toward the cam 216; and a sliding support 214 that is located on the end (the upper side in FIG.

4) of the punching member 215 and that is in slidable contact with the cam 216. The cam 216 is in contact with the sliding support 214 and slides on the sliding support 214. The cam 216 is rotated by a drive unit including a motor and a reduction mechanism (the drive unit is not illustrated). The punching member 215 is lifted up and down in accordance with the rotation position of the cam 216. Here, the cam 216 is an eccentric cam. In the present embodiment, the punching member 215 is arranged above the upper sixth conveyance guide plate 208, and the punching member 215 fits into a dice (not illustrated) arranged on the lower side when the punching member 215 is moved downward, whereby a punch area of the sheet is punched.

As illustrated in FIG. 4, a protruding portion (a protrusion) 204*a* is formed on the upper fourth conveyance guide plate 204 in a direction perpendicular to the sheet conveying direction D1. A sheet-position detection sensor 212 is arranged upstream of the second conveying roller 201 on the lower fourth conveyance guide plate 205.

In the punching unit 200 that is configured roughly as described above, as illustrated in FIG. 5, the sheet P conveyed from the upstream side in the direction of the arrow D1 abuts on the nip of the pair of third conveying rollers 202 that are not rotating, whereby a deflection P1 is formed. The leading end of the sheet is in linear contact with the nip of the pair of third conveying rollers 202 so that the alignment of the sheet P is corrected. A pair of conveying rollers does not need to be used as the member on which the leading end of the sheet P abuts to correct the alignment of the sheet P. An abutting plate may be located between the fifth conveyance guide plates 206 and 207 so that the sheet can abut on the plate. In terms of functionality, the pair of third conveying rollers 202 corresponds to what are called registration rollers.

Figure 6:
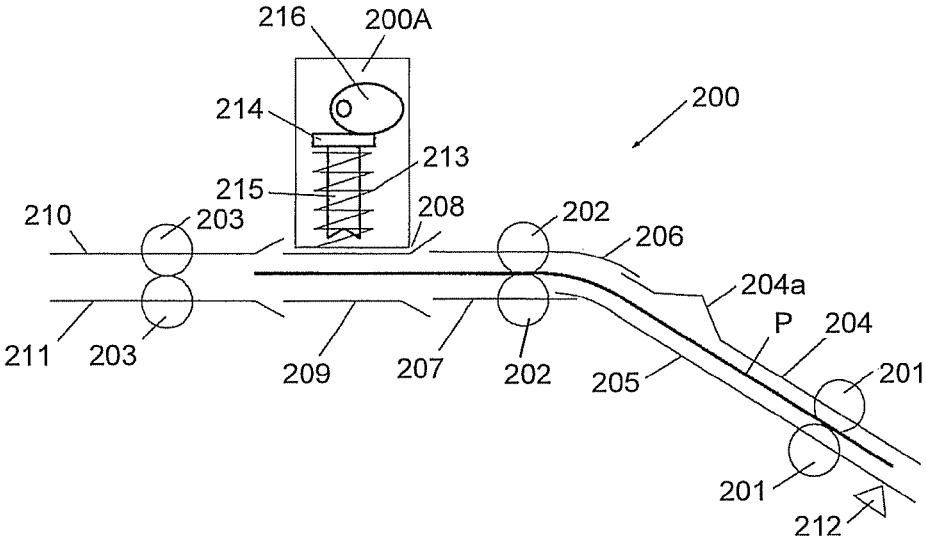
FIG. 6 is an explanatory diagram that illustrates the sheet-alignment correcting mechanism and the position setting mechanism of the punching unit and illustrates a state where the sheet is conveyed to a punching position after the alignment of the sheet is corrected.
Figure 7:
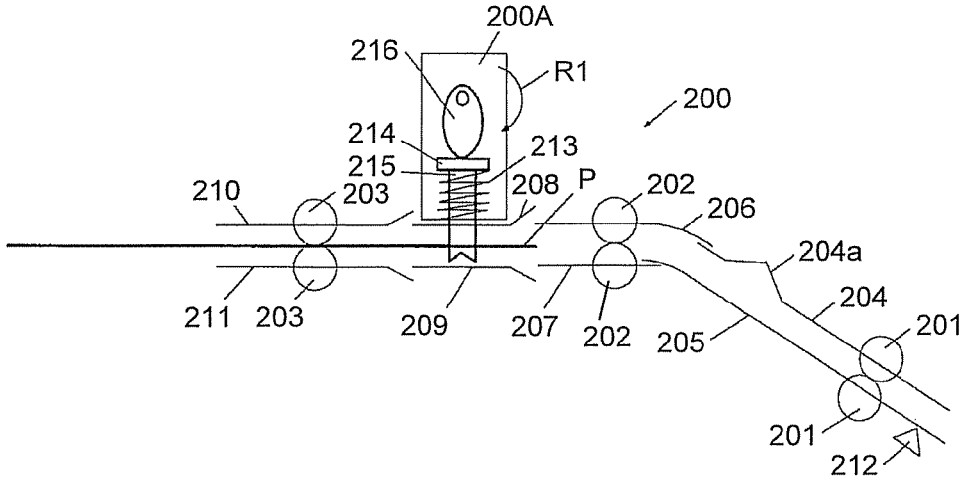
FIG. 7 is an explanatory diagram that illustrates the sheet-alignment correcting mechanism and the position setting mechanism of the punching unit and illustrates a state where the sheet is punched at the punching position.

After the position of the leading end is corrected, the sheet P is conveyed, as illustrated in FIG. 6. In this process, the sheet-position detection sensor 212 detects the trailing end of the sheet P, and the CPU 100*a*, which will be described later, of the sheet post-processing apparatus 100 acquires information on the sheet position. The CPU 100*a* controls the rotation of the pair of second, of third, and of fourth conveying rollers 201, 202, and 203 in accordance with the acquired information on the sheet position and stops the sheet P at the punching position, as illustrated in FIG. 7. If the sheet P is stopped at the punching position in accordance with the information on the sheet position, the sheet P may be stopped when a predetermined time has elapsed after the sheet position is detected or the sheet P may be stopped after being conveyed for a predetermined distance (amount of the rotation of the conveying unit).

After the sheet P is stopped, the cam 216 of the punching mechanism 200A rotates in the direction indicated by an arrow R1 (in the clockwise direction as illustrated in FIG. 7), the sliding support 214 is pushed out, and the punching member 215 is pushed out together with the sliding support 214, so that the punching member 215 punches, with the dice, the sheet P. The cam 216 is continuously rotated, and the sliding support 214 and the punching member 215 are pushed by the elastic member 213 to return to the original positions. The sheet P is again conveyed downstream in the sheet conveying direction, and the punching process is completed.

Binding Unit

Figure 8:
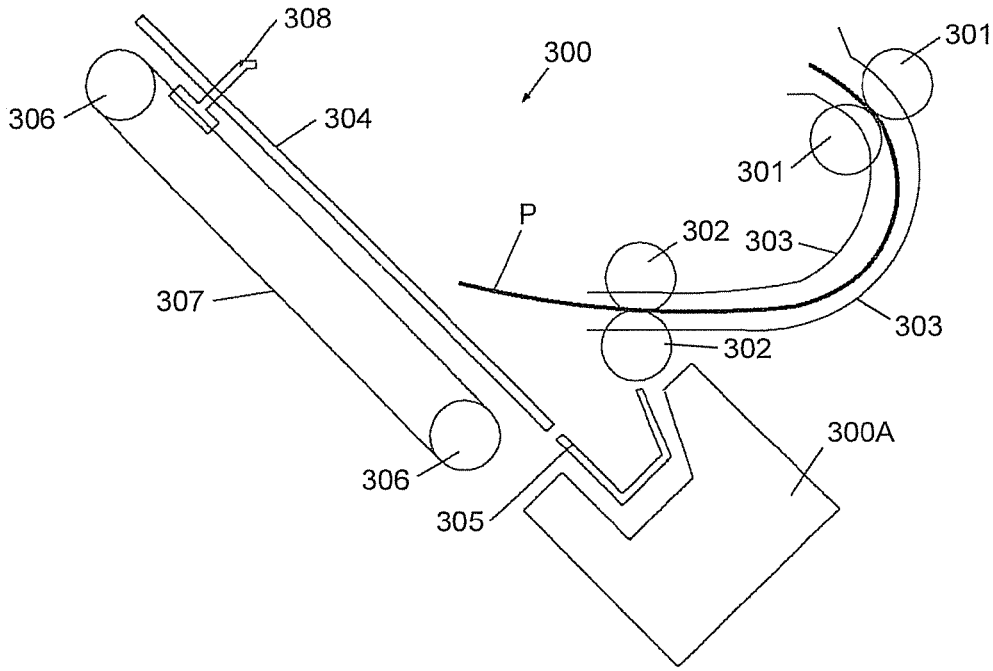
FIG. 8 is an explanatory diagram that illustrates a sheet-alignment correcting mechanism and a position setting mechanism of a binding unit and illustrates a state where a sheet is conveyed to a processing tray.
Figure 9:
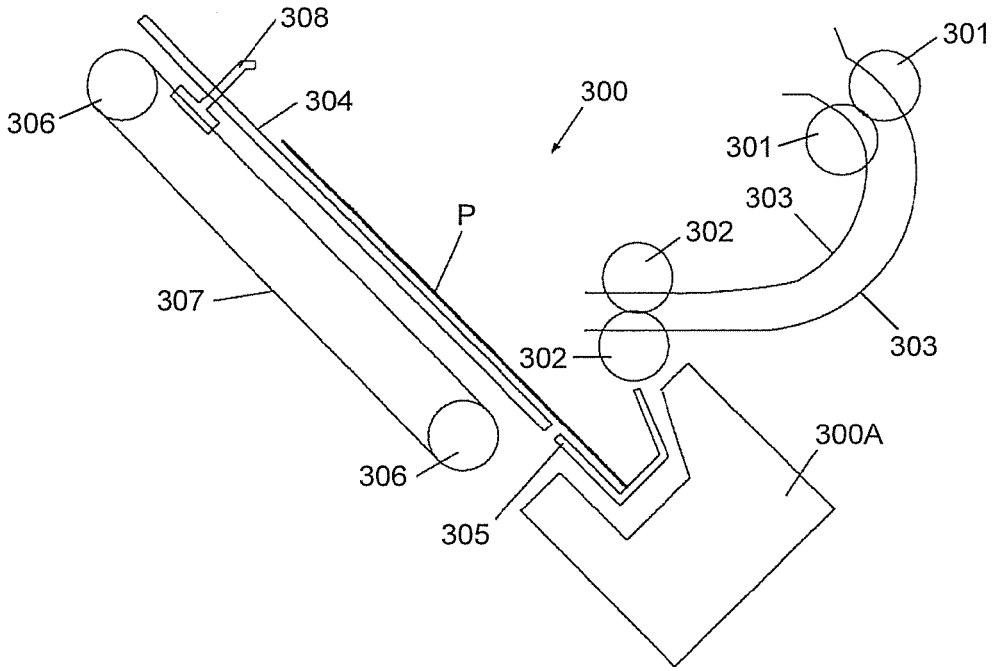
FIG. 9 is an explanatory diagram that illustrates the sheet-alignment correcting mechanism and the position setting mechanism of the binding unit and illustrates a state where the sheet has been discharged into the processing tray.
Figure 10:
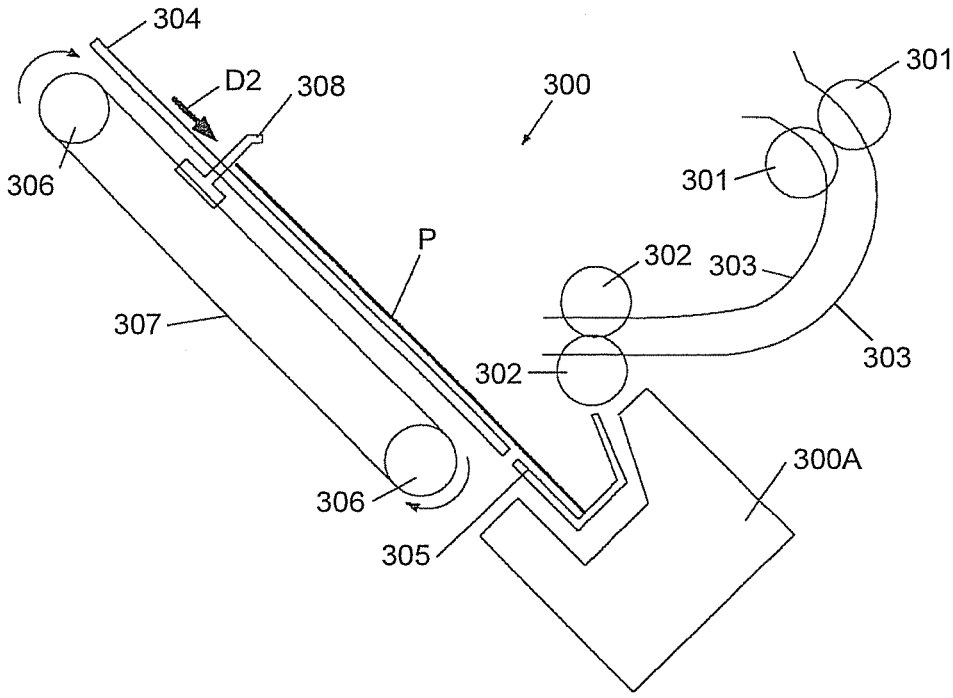
FIG. 10 is an explanatory diagram that illustrates the sheet-alignment correcting mechanism and the position setting mechanism of the binding unit and illustrates a state where the alignment of the sheet is corrected in the processing tray.

FIGS. 8 to 10 are explanatory diagrams that illustrate a sheet-alignment correcting mechanism and a position setting mechanism of the binding unit 300 that performs a binding process as post-processing in the sheet post-processing apparatus 100.

FIG. 8 is a diagram illustrating a state where the sheet P is conveyed to the processing tray. In FIG. 8, the binding unit 300 includes a pair of fifth and of sixth conveying rollers 301, 302, each pair of which sandwiches and conveys a sheet; a pair of eighth conveyance guide plates 303 that are made up of a pair of curved guide plates through which a sheet is conveyed; and the processing tray 304 that is located downstream of the pair of eighth conveyance guide plates 303 in the conveying direction. The sheet P is discharged to and temporarily stored on the processing tray 304. The base fence 305 that aligns the trailing end of a sheet is located on the upstream side (on the side of the trailing end of a sheet) of the processing tray 304 in the sheet conveying direction. An endless belt 307 is placed under the processing tray 304. The belt 307 is stretched between a pair of pulleys 306 including a drive pulley and a driven pulley. A tapping member 308 that taps the leading end of the sheet toward the base fence 305 is formed in a standing manner as an integral part of the belt 307. Furthermore, a binding mechanism (stapler) 300A is located under the lower end of the processing tray 304. The binding mechanism 300A sandwiches the front and back sides of the trailing end of a sheet. The binding mechanism 300A can perform a binding process on the sheet P at a position where the binding process does not interfere with the base fence 305.

In the binding unit 300 that is configured roughly as described above, the sheet P is conveyed by the pair of fifth and of sixth conveying rollers 301, 302 and discharged to the processing tray 304, as illustrated in FIG. 9. Then, the sheet P is moved down to the upstream side in the sheet conveying direction due to the weight of the sheet P, and the trailing end of the sheet P abuts on the base fence 305 so that the processing position for the binding process is set. Afterward, as illustrated in FIG. 10, the pulleys 306 are rotated by a drive mechanism (not illustrated) so that the belt 307 is rotated, and the tapping member 308 is moved in the direction indicated by an arrow D2 so as to tap the leading end of the sheet, whereby the trailing end of the sheet P securely abuts against the base fence 305. Thus, the alignment of the sheet P is corrected. This operation is repeated for a number of sheets to be bound, and the sheets are stacked on the processing tray 304. Afterward, the binding mechanism 300A performs a binding process on a sheaf of sheets, and then the sheaf of sheets is discharged. The sheaf of sheets is discharged by a discharging mechanism that is not illustrated in the drawings.

Folding Unit

FIGS. 11 to 14 are explanatory diagrams that illustrate a sheet-alignment correcting mechanism and a position setting mechanism of the folding unit 400 that performs a folding process as post-processing in the sheet post-processing apparatus 100.

Figure 11:
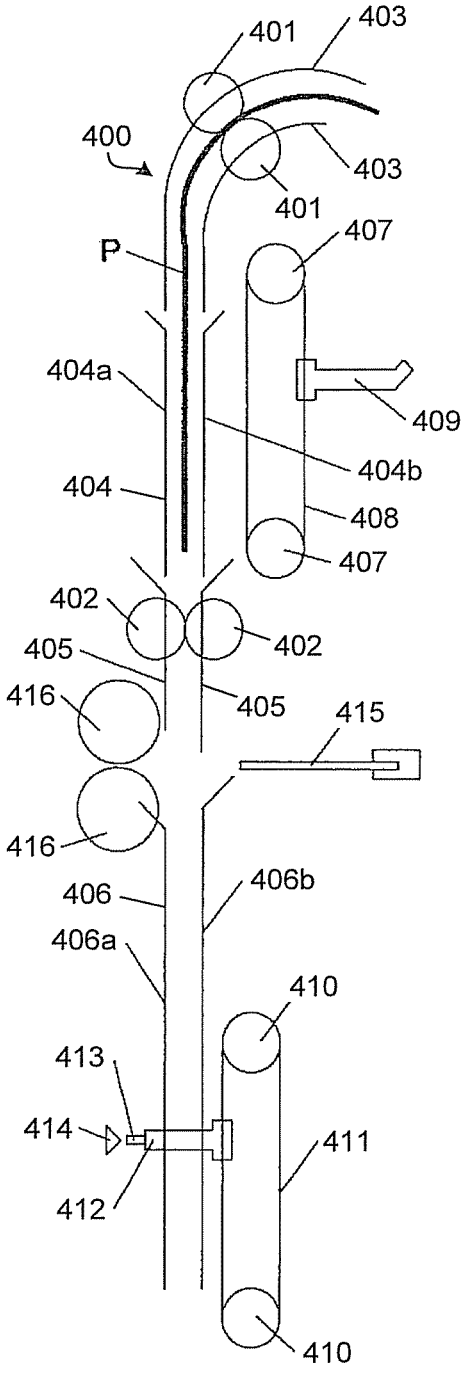
FIG. 11 is an explanatory diagram that illustrates a sheet-alignment correcting mechanism and a position setting mechanism of a folding unit and illustrates a state where a sheet has been conveyed to the folding unit.

As illustrated in FIG. 11, the folding unit (here, center-folding unit) 400 includes a pair of seventh and of eighth conveying rollers 401 and 402, each pair of which sandwiches a sheet to be conveyed, and a pair of ninth, of tenth, of eleventh, and of twelfth conveyance guide plates 403, 404 (404*a* and 404*b*), 405, and 406 (406*a* and 406*b*) through which a sheet is conveyed. The folding unit 400 further includes an endless belt 408 that is arranged along a tenth conveyance guide plate 404*b* and is stretched between a pair of pulleys 407 including a drive pulley and a driven pulley; a trailing end tapping member 409 that is formed in a standing manner as an integral part of the belt 408 to correct the alignment of a sheet; the endless belt 411 that is arranged along a twelfth conveyance guide plate 406*b* and is stretched between the pair of pulleys 410 including a drive pulley and a driven pulley; and the base fence 412 that is formed in a standing manner as an integral part of the endless belt 411 to set a position where a sheet is to be folded. The pair of twelfth conveyance guide plates 406 includes conveyance guide plates 406*a* and 406*b*.

A filler 413 is arranged on the leading end of the base fence 412 and detects the position of the base fence 412. A detection sensor 414 is located at a predetermined position on the side of the twelfth conveyance guide plate 406*a* that is opposed to the filler 413 so as to detect the filler 413. A pair of folding rollers 416 is located between the lower end of the pair of eleventh conveyance guide plates 405 and the upper end of the pair of twelfth conveyance guide plates 406. A folding plate 415 is located at a position opposed to the nip of the pair of folding rollers 416 with the sheet conveying path of the eleventh and twelfth conveyance guide plates 405 and 406 interposed therebetween.

Figure 12:
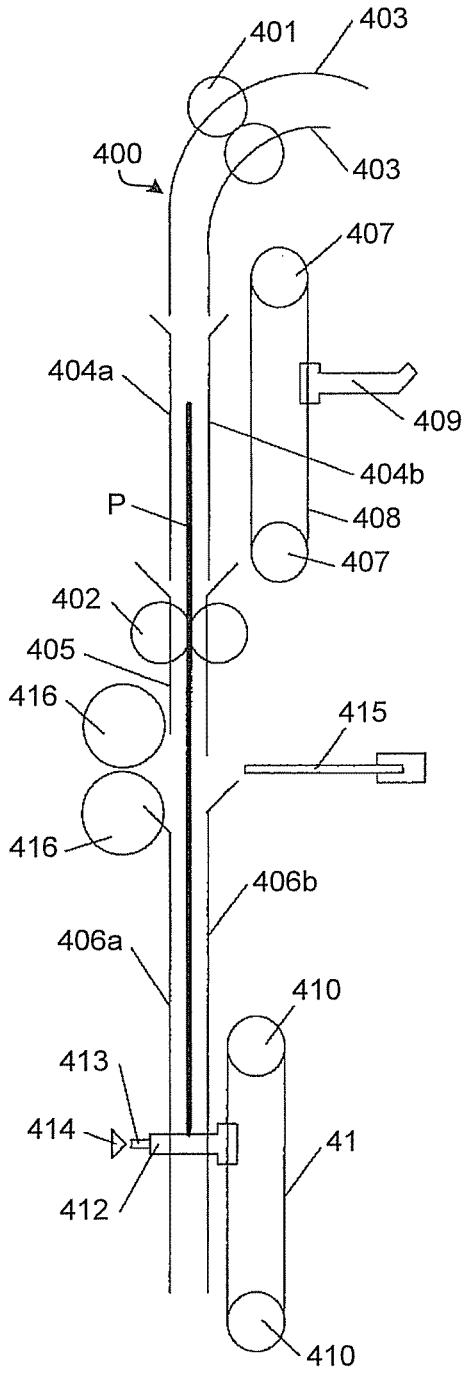
FIG. 12 is an explanatory diagram that illustrates the sheet-alignment correcting mechanism and the position setting mechanism of the folding unit and illustrates a state where the sheet is in contact with a base fence.

In the folding unit 400 that is configured roughly as described above, the sheet P is conveyed by the seventh and eighth conveying rollers 401 and 402, as illustrated in FIG. 11, and the leading end of the sheet P abuts on the base fence 412 that protrudes into the conveying path formed by the twelfth conveyance guide plates 406, as illustrated in FIG. 12. The base fence 412 is moved to a predetermined position in accordance with the detection position of the filler 413 by using the detection sensor 414 and sheet information on the conveyed sheet P and stands by at the position. This position is set by the CPU 100*a* of the sheet post-processing apparatus 100 according to the detection position of the filler 413 and the sheet information on the conveyed sheet P.

Figure 13:
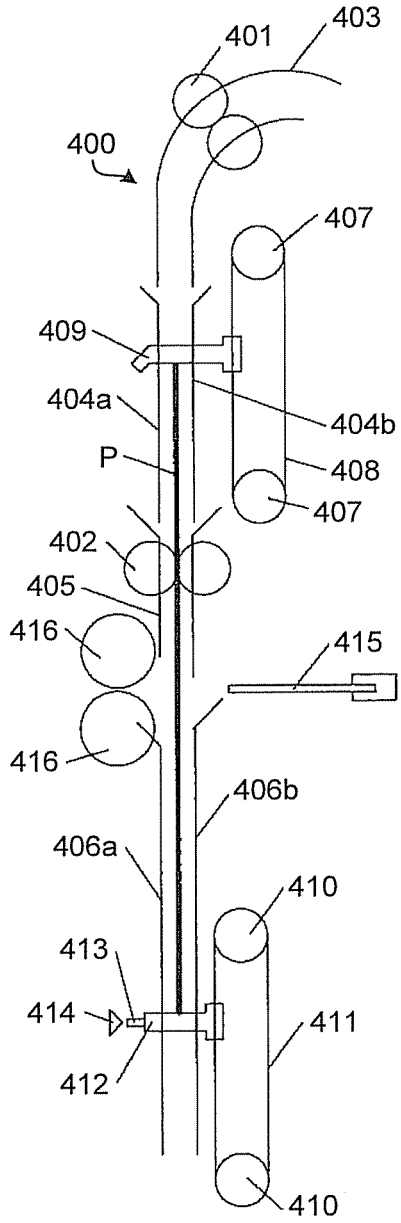
FIG. 13 is an explanatory diagram that illustrates the sheet-alignment correcting mechanism and the position setting mechanism of the folding unit and illustrates a state where the leading end of the sheet is in contact with the base fence and the trailing end of the sheet is tapped so that the alignment is corrected.
Figure 14:
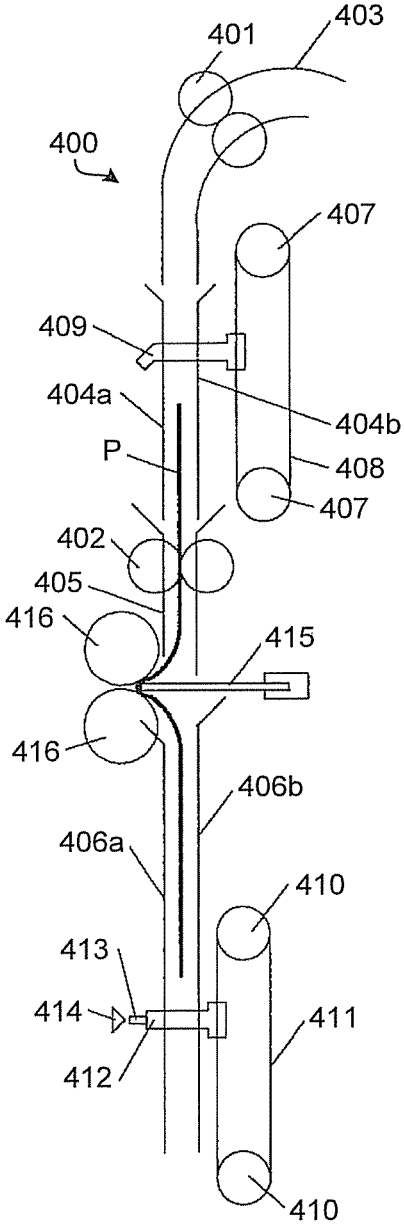
FIG. 14 is an explanatory diagram that illustrates the sheet-alignment correcting mechanism and the position setting mechanism of the folding unit and illustrates a state where the sheet is subjected to a folding process at a folding position.

After the sheet P or a sheaf Pa of sheets (in the case of the sheaf Pa of sheets, a plurality of sheets is stacked on the processing tray 304 and conveyed integrally) abuts on the base fence 412, the tapping member 409 is moved, as illustrated in FIG. 13, so as to tap the trailing end of the sheet and correct the alignment of the sheet P or the sheaf Pa of sheets. At this position or the center-folding position to which the sheet P or the sheaf Pa of sheets is pushed up by the base fence 412, the folding plate 415 is pushed toward the nip of the pair of folding rollers 416 so that the sheet P or the sheaf Pa of sheets is pushed into the nip of the pair of folding rollers 416 and is folded by the pair of folding rollers 416. Afterward, the folded sheet P or the sheaf Pa of folded sheets is conveyed by the pair of folding rollers 416 and discharged to the stacking tray 180.

First Embodiment

FIGS. 15 to 19 are operation explanatory diagrams that illustrate a punching operation and a creasing operation performed by the sheet post-processing apparatus 100 in a first embodiment. In the first embodiment, the creasing mechanism 500 of the present embodiment is used with the punching unit 200 that has been described with reference to FIGS. 4 to 7. Specifically, in the first embodiment, creasing is performed by using the sheet-alignment correcting mechanism and the position setting mechanism of the punching unit 200. The same reference numerals are attached to the same units as those in FIGS. 2 to 7, and repeated explanations are omitted.

Figure 15:
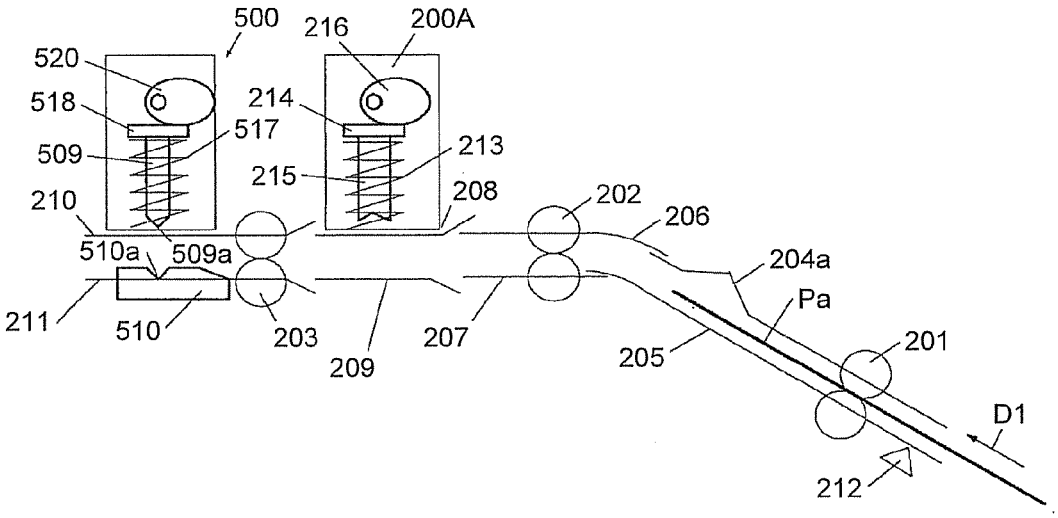
FIG. 15 is an explanatory diagram in a case where the creasing mechanism performs a creasing process in the punching unit and illustrates a state where a sheet has been conveyed.

As illustrated in FIG. 15, a sliding support 518, that is similar to the sliding support 214 of the punching mechanism 200A, is integrally mounted on the upper end of the creasing member 509 of the creasing mechanism 500. An elastic member 517, such as a spring, is located under the sliding support 518. A cam 520 is located on top of the sliding support 518. The cam 520 has nearly the same structure as that of the cam 216 of the punching mechanism 200A illustrated in FIG. 4 and functions in the same way as the cam 216 of the punching mechanism 200A (direction of rotation of the cam 216 is indicated by an arrow R3 in FIG. 19).

The receiving board 510 is arranged on the seventh conveyance guide plate 211 that is a lower member of the pair of the seventh conveyance guide plates 210 and 211, and the creasing concave blade 510*a* of the receiving board 510 is opposed to the creasing convex blade 509*a* of the creasing member 509 that is arranged above the upper seventh conveyance guide plate 210 that is an upper member of the pair of the seventh conveyance guide plates 210 and 211. When the creasing member 509 is moved down, the creasing convex blade 509*a* fits into the creasing concave blade 510*a* so that a crease can be formed. The relation between the creasing member 509 and the receiving board 510 is the same as that in the creasing mechanism 500 that has been described with reference to FIGS. 2 and 3. In the example illustrated in FIG. 15, the creasing mechanism 500 is arranged downstream of the punching mechanism 200A in a sheet conveying direction to be in line with each other; however, the positions of the creasing mechanism 500 and the punching mechanism 200A can be interchanged therebetween.

The other units that are not explained in the present embodiment are the same as those of the creasing mechanism 500, which has been described with reference to FIGS. 2 and 3, or those of the punching unit 200, which has been described with reference to FIGS. 4 to 7.

Figure 16:
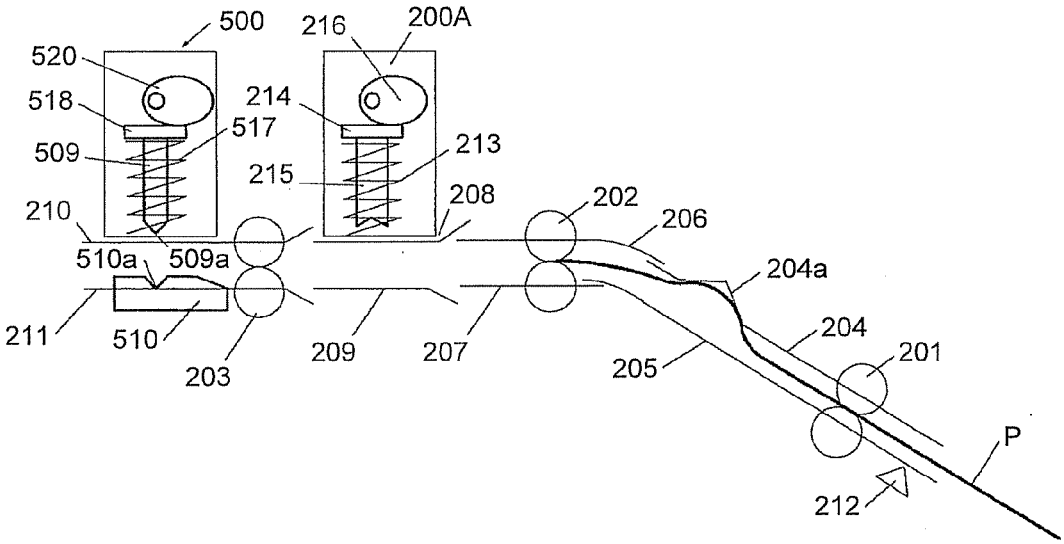
FIG. 16 is an explanatory diagram in a case where the creasing mechanism performs a creasing process in the punching unit and illustrates a state where the alignment of the sheet is corrected.
Figure 17:
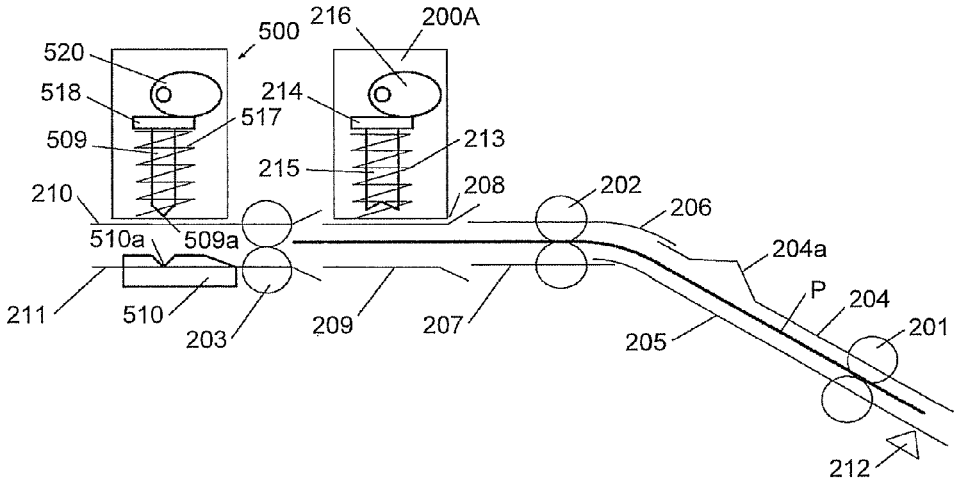
FIG. 17 is an explanatory diagram in a case where the creasing mechanism performs a creasing process in the punching unit and illustrates a state where the sheet is conveyed to a punching position after the alignment of the sheet is corrected.
Figure 18:
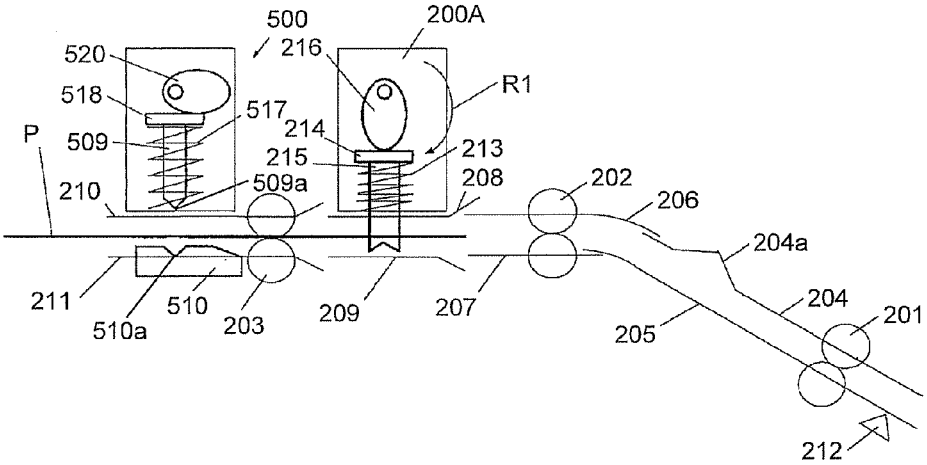
FIG. 18 is an explanatory diagram in a case where the creasing mechanism performs a creasing process in the punching unit and illustrates a state where the sheet is punched at the punching position.
Figure 19:
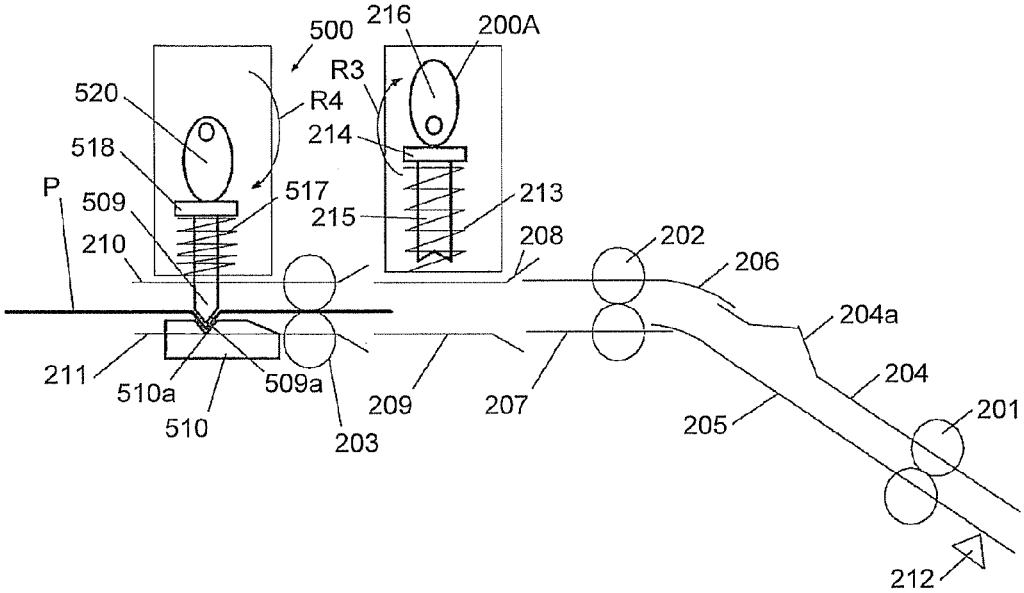
FIG. 19 is an explanatory diagram in a case where the creasing mechanism performs a creasing process in the punching unit and illustrates a state where the creasing process is performed on the sheet after the sheet is punched.

In the sheet post-processing apparatus 100 that is configured as described above, the sheet P is conveyed from the pair of second conveying rollers 201 through a path between the pair of fourth conveyance guide plates 204 and 205, as illustrated in FIG. 15, the leading end of the sheet abuts on the nip of the pair of third conveying rollers 202 that are not rotating, so that a deflection is formed, as illustrated in FIG. 16, and the alignment of the sheet P is corrected. Afterward, the sheet P is further conveyed and, when the sheet-position detection sensor 212 detects the trailing end of the sheet, as illustrated in FIG. 17, the CPU 100*a* causes the sheet P to be stopped at the punching position by using information on the detected position and causes the sheet P to be punched, as illustrated in FIG. 18. Then, the CPU 100*a* again causes the sheet P to be conveyed and stopped at the creasing position by using the position information of the sheet P and, as illustrated in FIG. 19, operates (rotates) the cam 520 in the creasing mechanism 500 (direction of rotation of the cam 520 is indicated by an arrow R4 in FIG. 19). Thus, the creasing member 509 is moved downward so that pressure is applied to the sheet P by the creasing convex blade 509*a* and the creasing concave blade 510*a* whereby a creasing process is performed. After a crease is formed, the cam 520 is continuously operated so that the creasing member 509 is returned to the original position due to the elastic force of the elastic member 517, and the gap between the creasing convex blade 509*a* and the creasing concave blade 510*a* is opened so that the sheet P is conveyed downstream in the sheet conveying direction.

The operations illustrated in FIGS. 15 to 18 are the same as those of the punching unit 200, which have been explained with reference to FIGS. 4 to 7.

In the first embodiment, the punching process and the creasing process are performed; however, only the creasing process may be performed without performing the punching process. In such a case, the sheet is not stopped at the punching position. Instead, the sheet is stopped at the creasing position and is subjected to a creasing process.

Second Embodiment

FIGS. 20 to 23 are operation explanatory diagrams that illustrate a binding operation and a creasing operation of the sheet post-processing apparatus 100 in a second embodiment. In the second embodiment, the creasing mechanism 500 of the present embodiment is used with the binding unit 300 that has been described with reference to FIGS. 8 to 10. Specifically, in the second embodiment, creasing is performed by using the sheet-alignment correcting mechanism and the position setting mechanism of the binding unit 300. In the following descriptions, the units that are the same as those in FIGS. 2 and 3 and FIGS. 8 to 10 are denoted by the same reference numerals, and repeated explanations are omitted.

Figure 20:
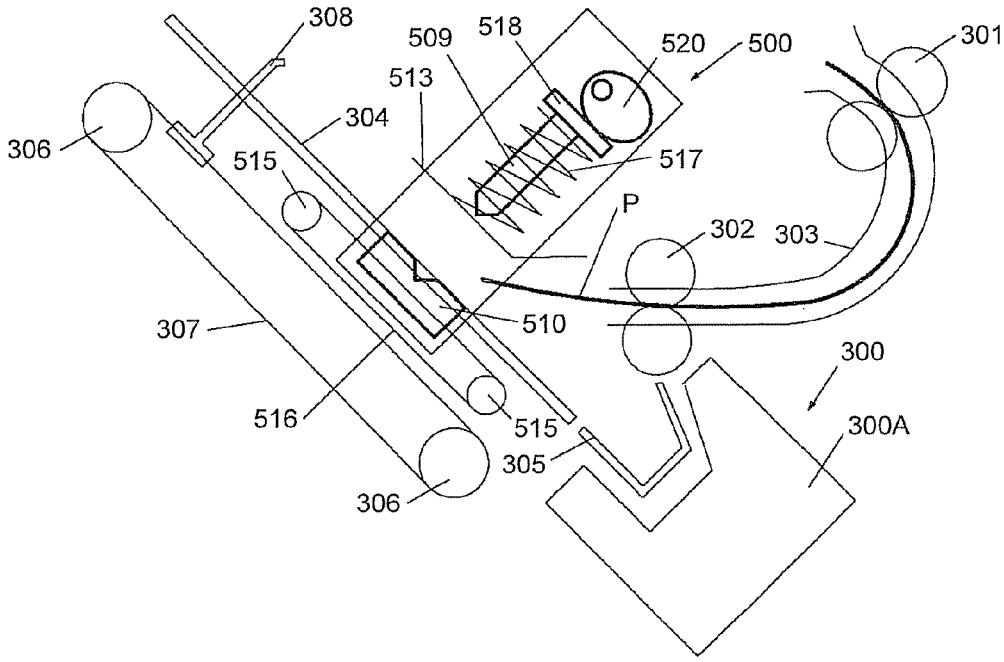
FIG. 20 is an explanatory diagram in a case where the creasing mechanism performs a creasing process in the binding mechanism and illustrates a state where a sheet is conveyed to the processing tray.

In the present embodiment, as illustrated in FIG. 20, the creasing mechanism 500 is arranged such that the creasing mechanism 500 can be moved in a direction parallel to the processing tray 304. Specifically, a top surface of the processing tray 304 and a top surface of the receiving board 510 lie in the same plane, and the receiving board 510 of the creasing mechanism 500 is attached to the endless belt 516 that is located between the processing tray 304 and the belt 307 and is stretched between the pair of pulleys 515 formed by a drive pulley and a driven pulley. When the pulleys 515 are rotated, in a direction indicated by an arrow R5 in FIG. 21, by a drive mechanism (not illustrated), the entire creasing mechanism 500 is moved together with the endless belt 516. The creasing mechanism 500 is moved within the moving range of the endless belt 516. The creasing mechanism 500 is moved in a direction parallel to the top surface of the processing tray 304 within the moving range. The reference numeral 513 denotes a conveyance guide plate placed between the receiving board 510 and the creasing convex blade 509*a*, and the conveyance guide plate 513 corresponds to the sixth conveyance guide plates 208 in FIG. 4 and the seventh conveyance guide plate 210 illustrated in FIG. 19.

The other units that are not explained are the same as those of the creasing mechanism 500, which has been explained with reference to FIGS. 2 and 3, and are the same as those of the binding unit 300, which has been explained with reference to FIGS. 8 to 10.

Figure 22:
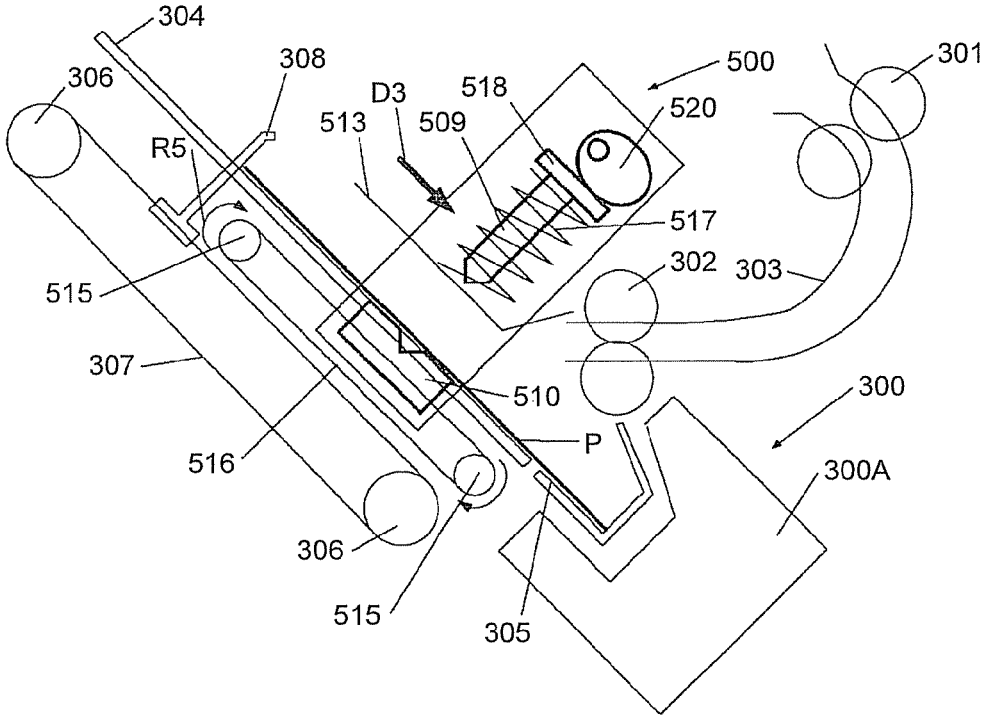
FIG. 22 is an explanatory diagram in a case where the creasing mechanism performs a creasing process in the binding mechanism and illustrates a state where the alignment of the sheet is corrected on the processing tray.
Figure 23:
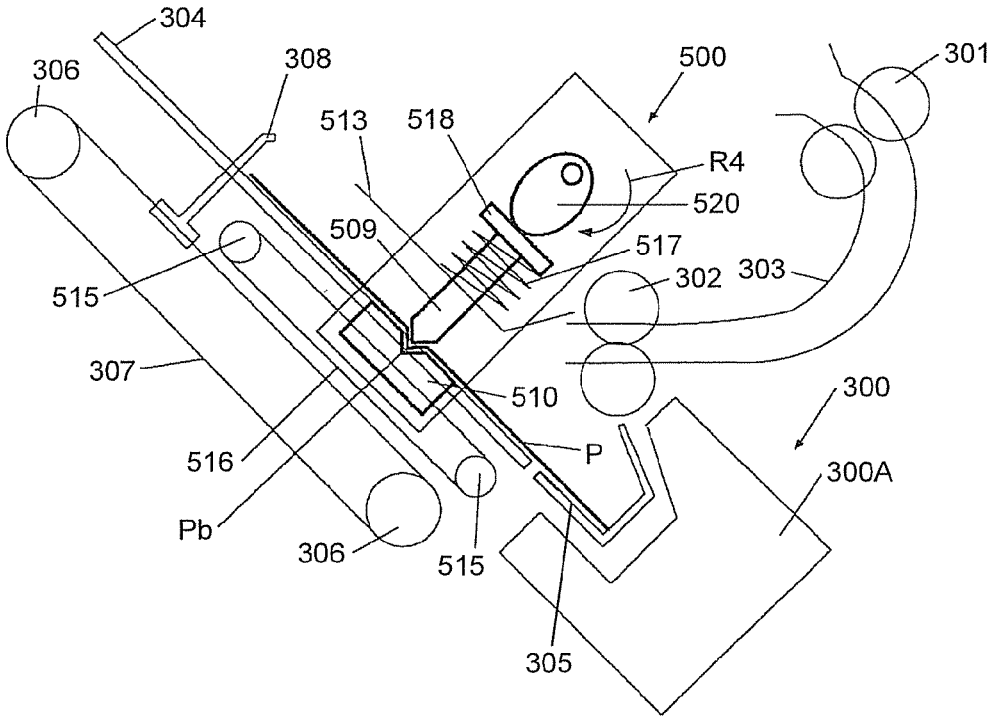
FIG. 23 is an explanatory diagram in a case where the creasing mechanism performs a creasing process in the binding mechanism and illustrates a state where the creasing process is performed on the sheet on the processing tray.

In the sheet post-processing apparatus 100 that is configured as described above, the sheet P is conveyed toward the processing tray 304 by the pair of fifth and of sixth conveying rollers 301 and 302, as illustrated in FIG. 20, discharged to the processing tray 304 by the pair of sixth conveying rollers 302, and abuts on the base fence 305, which is located on the side of the trailing end of the sheet P, due to the weight of the sheet P so that the processing position in the sheet conveying direction is set. The CPU 100*a* determines the creasing position by using the position of the base fence 305 and the size information on the sheet P and causes the creasing mechanism 500 to move to the creasing position, as illustrated in FIG. 22. Meanwhile, the tapping member 308 taps the leading end of the sheet P so that the trailing end of the sheet P abuts on the base fence 305 to correct the alignment of the sheet in the sheet conveying direction. After the correction is performed, the cam 520 is rotated in a direction indicated by an arrow R4 in FIG. 23 to move down the creasing member 509 of the creasing mechanism 500, as illustrated in FIG. 23, and a crease is formed on the sheet P by the creasing convex blade 509*a* and the creasing concave blade 510*a*. Then, the cam 520 is continuously rotated so that the creasing member 509 is returned to the original position due to the upward bias of the elastic member 517, and the gap between the creasing convex blade 509*a* and the creasing concave blade 510*a* is opened so that the sheet P is conveyed downstream in the sheet conveying direction. When the alignment of the sheet P in the sheet conveying direction is corrected, as illustrated in FIG. 22, a pair of jogger fences (not illustrated) is brought into contact with both edges of the sheet P in a direction perpendicular to the sheet conveying direction so that an alignment of the sheet P in a direction (the width direction of the sheet P) perpendicular to the sheet conveying direction is performed.

Figure 21:
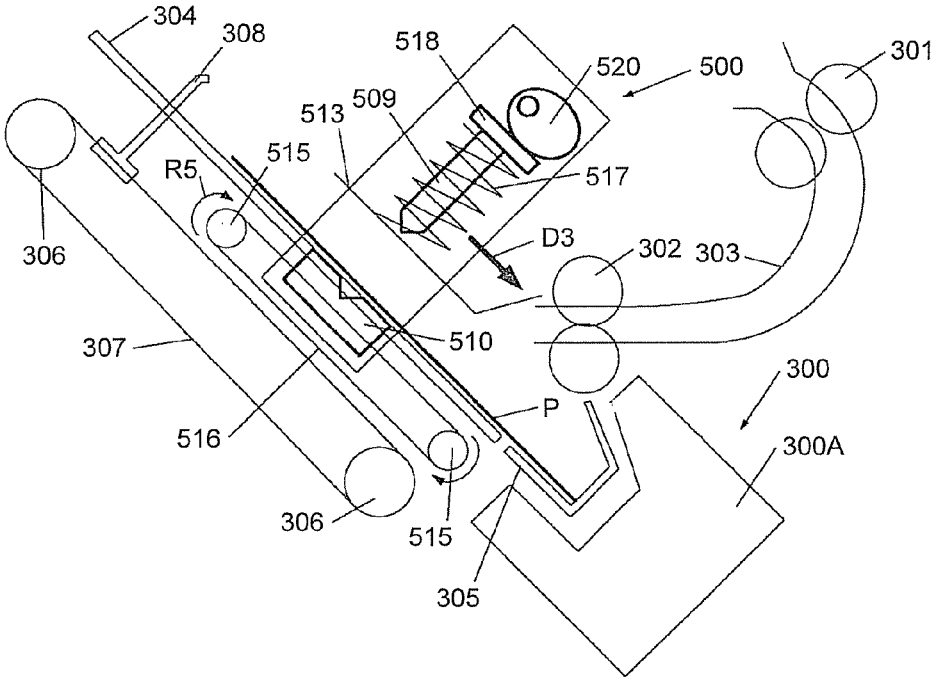
FIG. 21 is an explanatory diagram in a case where the creasing mechanism performs a creasing process in the binding mechanism and illustrates a state where the sheet has been discharged on the processing tray.

The operations illustrated in FIGS. 20 to 22 are the same as the operations of the binding unit 300, which has been explained with reference to FIGS. 8 to 10.

In the second embodiment, because the binding mechanism 300A and the creasing mechanism 500 are arranged in the same processing tray 304, an additional space for the creasing mechanism 500 need not be prepared, and a structure can be configured compactly.

Third Embodiment

FIGS. 24 to 28 are operation explanatory diagrams that illustrate a folding operation and a creasing operation of the sheet post-processing apparatus 100 in a third embodiment. In the third embodiment, the creasing mechanism 500 of the present embodiment is used with the folding unit 400, which has been explained with reference to FIGS. 11 to 14. Specifically, in the third embodiment, creasing is performed by using a sheet-alignment correcting mechanism and a position setting mechanism of the folding apparatus. In the following descriptions, the units that are the same as those in FIGS. 2 and 3 and FIGS. 11 to 14 are denoted by the same reference numerals, and repeated explanations are omitted.

Figure 24:
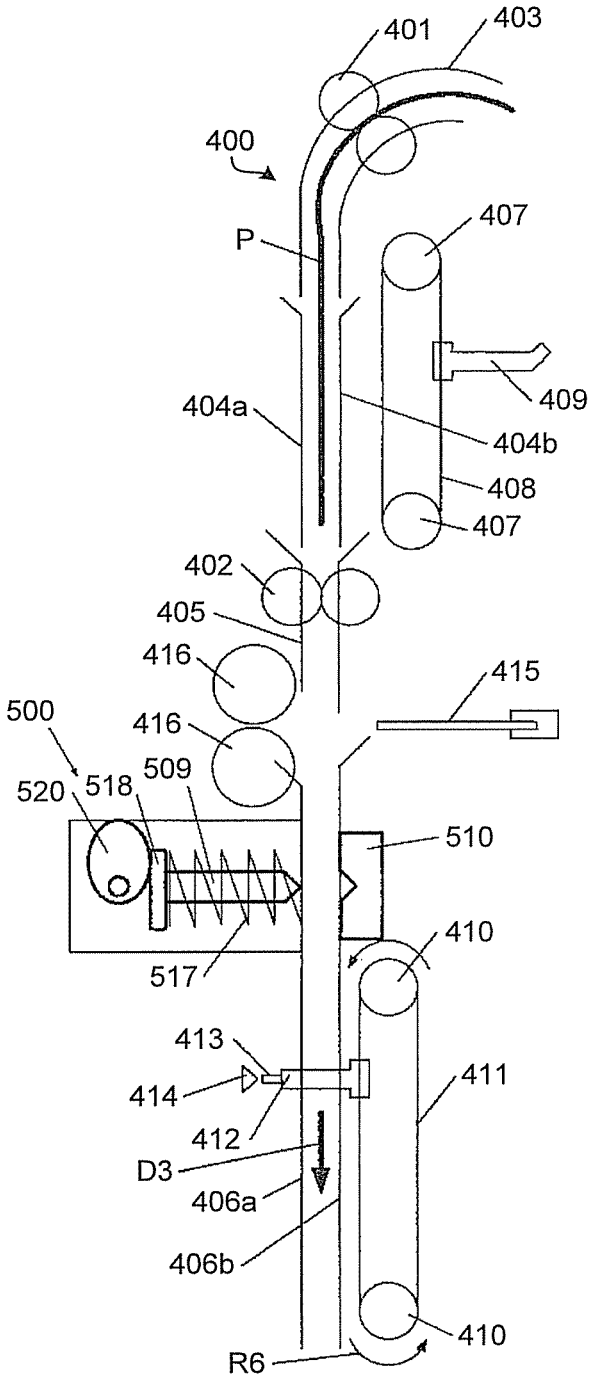
FIG. 24 is an explanatory diagram in a case where the creasing mechanism performs a creasing process in the folding mechanism and illustrates a state where a sheet has been conveyed to the folding unit.

In the present embodiment, as illustrated in FIG. 24, the creasing mechanism 500 is arranged (horizontally) perpendicular to the twelfth conveyance guide plates 406 that are arranged in the vertical direction. The creasing member 509 is arranged on the same side as the pair of folding rollers 416 relative to the twelfth conveyance guide plates 406, and the receiving board 510 is arranged on the same side as the folding plate 415 relative to the twelfth conveyance guide plates 406. The creasing mechanism 500 is located, along the twelfth conveyance guide plates 406, between the pair of folding rollers 416 and the pair of pulleys 410 that drives the base fence 412. The creasing mechanism 500 is the same as that illustrated in the first embodiment. The receiving board 510 is arranged so that the surface of the receiving board 510 on the side of the creasing concave blade 510*a* lies in the same plane as the inner surface of the twelfth conveyance guide plate 406*b* on the side where the drive mechanism of the base fence 412 is located. Initially, the leading edge of the creasing convex blade 509*a* is retracted from the position of the twelfth conveyance guide plate 406*a* on the side where the creasing member 509 is arranged.

The other units that are not explained are the same as those of the creasing mechanism 500, which has been explained with reference to FIGS. 2 and 3, or those of the binding unit 300, which has been explained with reference to FIGS. 11 to 14.

Figure 25:
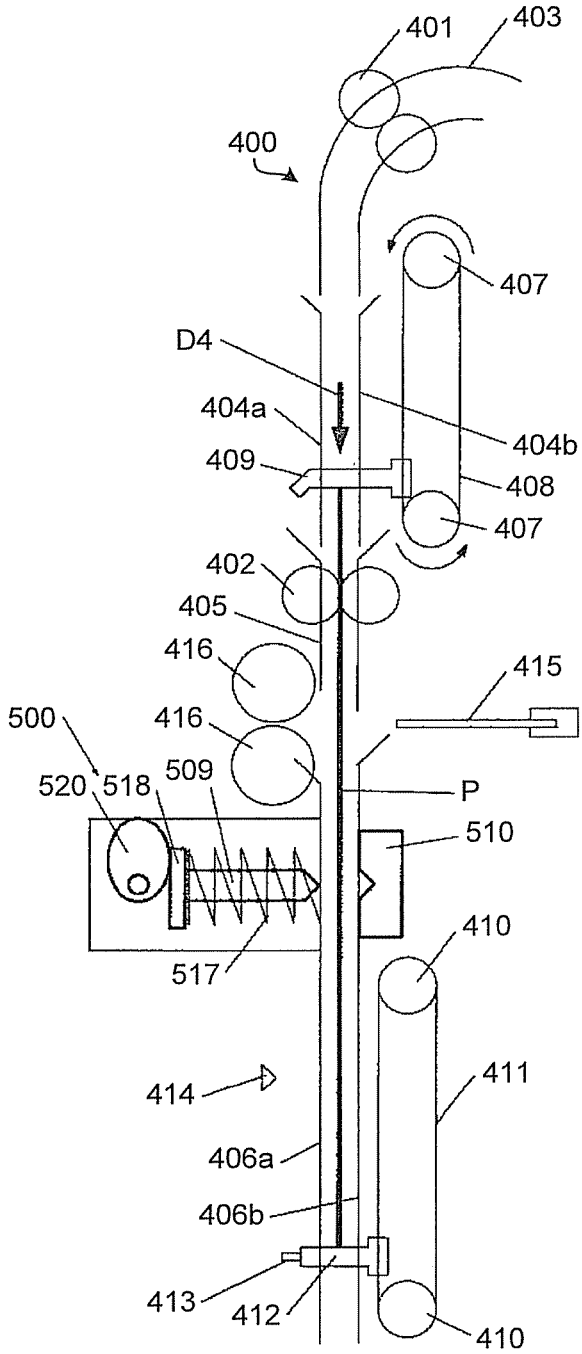
FIG. 25 is an explanatory diagram in a case where the creasing mechanism performs a creasing process in the folding mechanism and illustrates a state where the leading end of the sheet is in contact with the base fence and the trailing end of the sheet is tapped so that the alignment is corrected.
Figure 26:
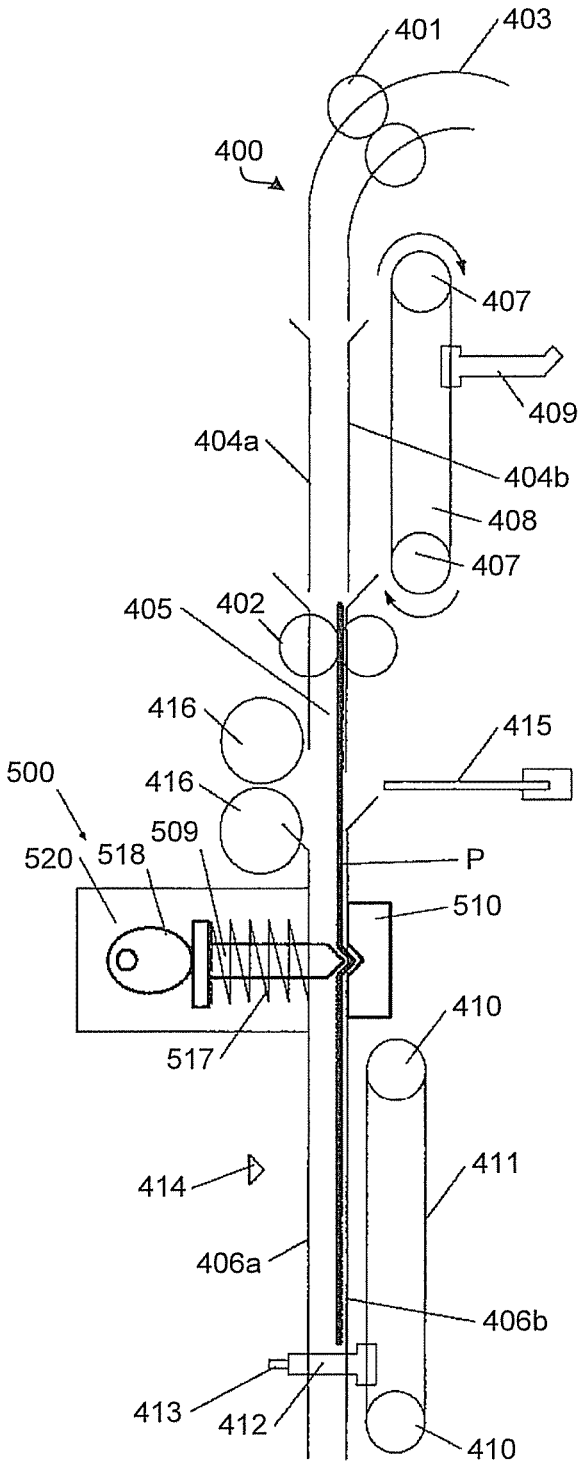
FIG. 26 is an explanatory diagram in a case where the creasing mechanism performs a creasing process in the folding mechanism and illustrates a state where a creasing process is performed on the sheet.

In the folding unit 400 that is configured roughly as described above, the sheet P is conveyed by the pair of seventh and of eighth conveying rollers 401 and 402, as illustrated in FIG. 24, the leading end of the sheet P abuts on the base fence 412 where the sheet P is stopped, as illustrated in FIG. 25. While the sheet P or the sheaf Pa of sheets is conveyed, the CPU 100*a* determines the creasing position by using the size information on the sheet P and the base fence 412 is moved (in the direction indicated by an arrow D3) to the creasing position illustrated in FIG. 25 from the home position (an initial position) illustrated in FIG. 24. In this state, if the sheet P or the sheaf Pa of sheets abuts on the base fence 412, the belt 408 is rotated and the tapping member 409 is moved downward in the direction of an arrow D4 so as to tap the trailing end of the sheet, whereby the alignment of the sheet P or the sheaf Pa of sheets is corrected. At this position, the creasing member 509 of the creasing mechanism 500 is pushed toward the receiving board 510 due to the rotation of the cam 520, the creasing convex blade 509*a* presses the sheet P or the sheaf Pa of sheets toward the creasing concave blade 510*a*, as illustrated in FIG. 26, and a crease is formed by the two blades 509*a*, 510*a*.

Figure 27:
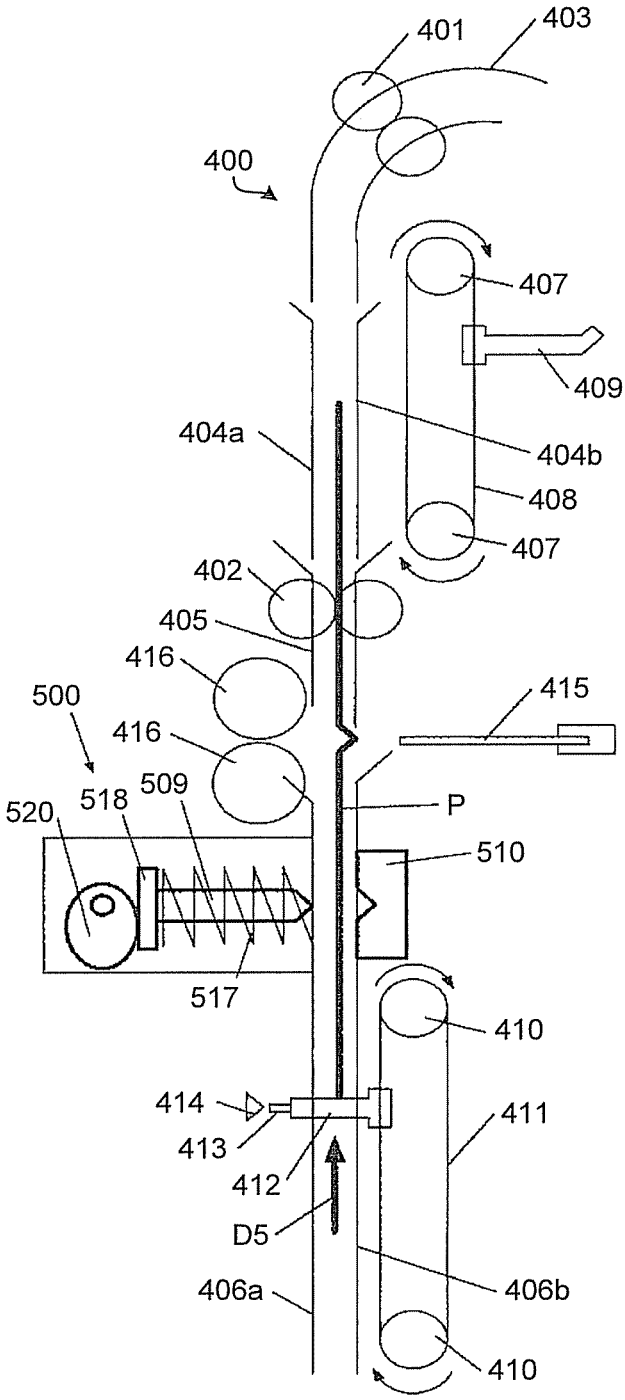
FIG. 27 is an explanatory diagram in a case where the creasing mechanism performs a creasing process in the folding mechanism and illustrates a state where the sheet has been moved to a folding position after the creasing process is performed on the sheet.
Figure 28:
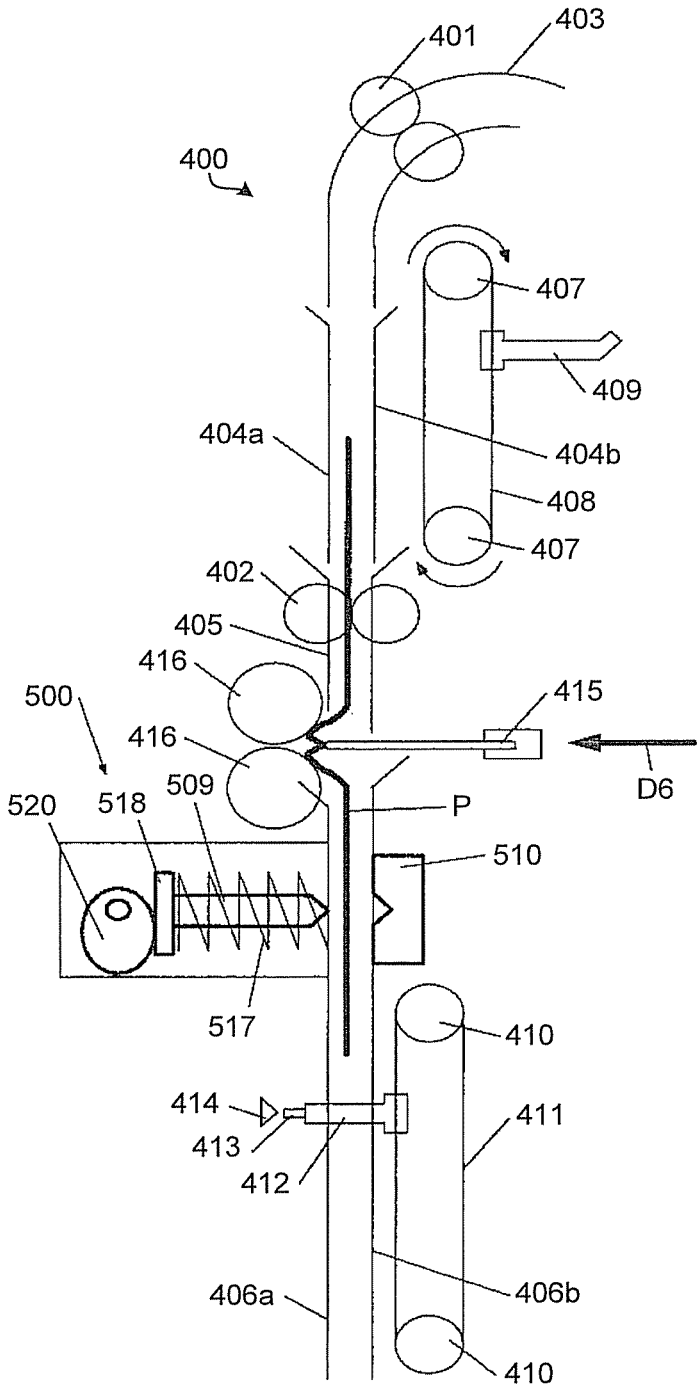
FIG. 28 is an explanatory diagram in a case where the creasing mechanism performs a creasing process in the folding mechanism and illustrates a state where a folding process is performed on the sheet at the folding position.

After the creasing process is performed, the creasing member 509 is retracted due to the rotation of the cam 520, and the gap between the creasing convex blade 509*a* and the creasing concave blade 510*a* is opened. Thus, the sheet P or the sheaf Pa of sheets can be moved. The CPU 100*a* drives the pulleys 410, which are a drive mechanism of the base fence 412, in accordance with size information on the sheet P and creasing information so as to, as illustrated in FIG. 27, lift up the sheet P or the sheaf Pa of sheets to the folding position (in the direction of an arrow D5). When the creased area of the sheet P or the sheaf Pa of sheets is located at the folding position, the CPU 100*a* operates the drive mechanism of the folding plate 415 and causes the folding plate 415 to be pushed out toward the creased area (in the direction of an arrow D6), as illustrated in FIG. 28. Thus, the leading edge of the folding plate 415 is brought into contact with an area to be creased, and the contacted area is pushed into the nip of the pair of folding rollers 416, whereby the folding process is performed. The sheet P or the sheaf Pa of sheets, on which the folding process has been performed, is conveyed by the pair of folding rollers 416 and discharged to the stacking tray 180.

The detection sensor 414, which is a home-position sensor, is located in a different position as illustrated in FIGS. 11 and 24. The position of the detection sensor 414 is determined according to a design, and it is only necessary to set the position of the base fence 412 in accordance with a position of the sheet P or the sheaf Pa of sheets detected by the detection sensor 414. For example, if an encoder is used for position detection or a stepping motor is used as a drive source, the position can be specified according to a drive step. The operations illustrated in FIGS. 24, 25, 27, and 28 are the same as the operation of the binding unit 300, which has been explained with reference to FIGS. 11 to 14.

As exemplified in the first to third embodiments, the creasing mechanism 500 is installed in any one of the punching unit 200, the binding unit 300, and the folding unit 400. Some sheet post-processing apparatuses 100 include only the binding unit 300 and the folding unit 400 but do not include the punching unit 200. Some folding processing apparatuses do not include a binding mechanism. Therefore, a unit in which the creasing mechanism 500 is installed is appropriately selected depending on the functionality of the sheet post-processing apparatus 100.

If the creasing mechanism 500 is installed in the punching unit 200 and the binding unit 300, a creasing process can be performed on the sheet P one by one. If the creasing process is performed on a sheaf of sheets in the folding unit 400, the creasing process is performed on a single sheet or a small number of sheets in a sheaf at once.

Figure 29:
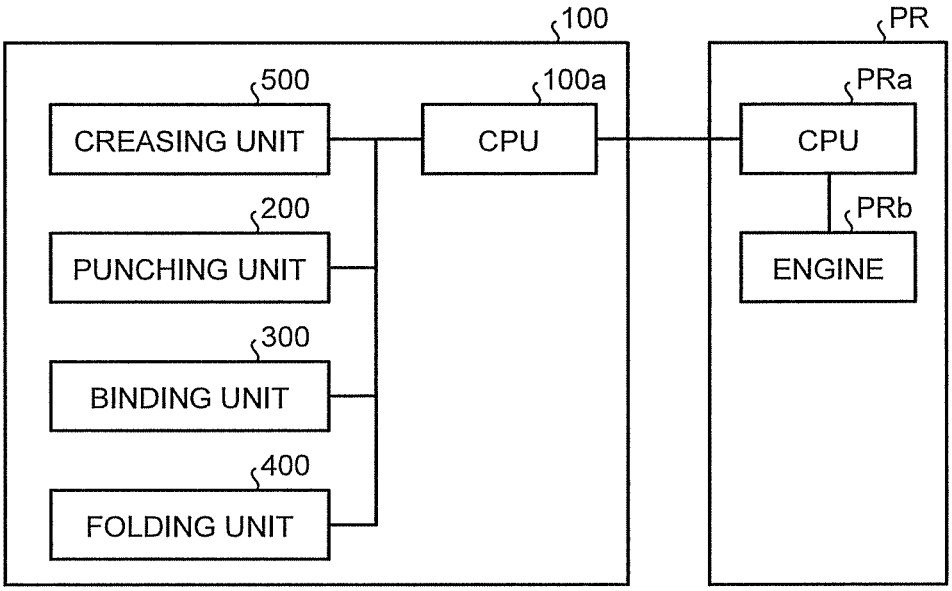
FIG. 29 is a block diagram illustrating the control configuration of an image forming system that includes a sheet post-processing apparatus and an image forming apparatus according to first to third embodiments.

FIG. 29 is a block diagram illustrating the control configuration of the image forming system that includes the sheet post-processing apparatus 100 and the image forming apparatus PR according to the first to third embodiments. The control configuration of the image forming system according to the present embodiment includes the image forming apparatus PR that includes an engine PRb and a CPU_PRa that is a control unit of the engine PRb. Furthermore, the control configuration of the image forming system according to the present embodiment includes the sheet post-processing apparatus 100 that includes the creasing mechanism 500, the punching unit 200, the binding unit 300, the folding unit 400, and the CPU 100*a* that is a control unit of the above units. The CPU_PRa of the image forming apparatus PR is connected to the CPU 100*a* of the sheet post-processing apparatus 100 via communication units such that they can communicate with each other via communication ports (not illustrated). The CPU 100*a* of the sheet post-processing apparatus 100 uses the CPU_PRa of the image forming apparatus PR as a main CPU and is controlled by the CPU_PRa of the image forming apparatus PR. Thus, each unit of the sheet post-processing apparatus 100 is in effect controlled by the CPU_PRa of the image forming apparatus PR.

Each of the CPU_PRa of the image forming apparatus PR and the CPU 100*a* of the sheet post-processing apparatus 100 includes a read-only memory (ROM) and random access memory (RAM) (not illustrated). A computer program stored in the ROM is loaded into the RAM, and the RAM is used as a work area and data buffer while control defined in each computer program is executed. Thus, each process is performed, such as conveying of the sheet P; alignment correction, a stop operation at a punching position, a punching process, and a stop operation and a creasing process at a creasing position in the punching unit 200; alignment correction, a creasing process, and a binding process in the binding unit 300; and alignment correction, a creasing process, and a folding process in the folding unit 400.

As described above, according to the present embodiment, 1) because a creasing mechanism is installed in any one of the post-processing units, it is possible to eliminate the need for a space for a creasing device that is conventionally installed between the image forming apparatus PR and the sheet post-processing apparatus 100 and it is possible to save space; 2) because it is not necessary to separately install a creasing device, it is possible to reduce energy consumption that is consumed except for driving the creasing mechanism 500; 3) because the alignment of the sheet is corrected by using a alignment correcting mechanism of the post-processing units such as the punching unit 200, the binding unit 300, or the folding unit 400 that is located close to the creasing mechanism 500, it is possible to improve accuracy of a creasing process and post-processing; and 4) because the creasing mechanism 500 is installed in the post-processing units such as the punching unit 200, the binding unit 300, or the folding unit 400, it is possible to prevent the size of the sheet post-processing apparatus 100 from increasing and to save space for creasing.

According to an aspect of the present invention, because sheet alignment correction and creasing are performed within a single post-processing unit, power consumption can be reduced and variation in accuracy of a creasing position and a position of each process can be kept at a minimum level.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a correcting unit that corrects alignment of a sheet, wherein the correcting unit includes a base fence that stops an end of the sheet on an upstream side in a sheet conveying direction so that a trailing end of the sheet is aligned;

a post-processing unit that performs post-processing on the sheet after the correcting unit corrects the alignment of the sheet, wherein the post-processing unit includes a binding unit, the binding unit including a tray on which a sheet is placed;

a creasing unit that forms a crease on the sheet after the correcting unit corrects the alignment of the sheet, the creasing unit is provided in the tray; and a position setting unit that sets a position of a sheet relative to the creasing unit, wherein the creasing unit performs a creasing process after the position setting unit sets the position, wherein the position setting unit includes a moving unit that moves the creasing unit in a direction parallel to the tray and sets the creasing unit at a position where a sheet is to be creased.

2. The sheet processing apparatus according to claim 1, wherein the creasing unit is arranged upstream of the post-processing unit in a sheet conveying direction.

3. The sheet processing apparatus according to claim 1, wherein the creasing unit is arranged downstream of the post-processing unit in a sheet conveying direction.

4. The sheet processing apparatus according to claim 1, wherein the post-processing unit includes a punching unit, the correcting unit includes a pair of conveying rollers, and a leading end of a sheet is aligned by abutting on a nip of the pair of conveying rollers while the sheet is conveyed.

5. The sheet processing apparatus according to claim 1, wherein the position setting unit includes a conveying unit that conveys a sheet after the correcting unit corrects alignment of the sheet; and a control unit that controls a conveying amount conveyed by the conveying unit.

6. The sheet processing apparatus according to claim 1, wherein the post-processing unit includes a folding unit that folds a sheet subjected to the creasing process.

7. The sheet processing apparatus according to claim 1, further comprising a tapping unit that taps one end of a sheet opposite to another end that faces the base fence so as to move the sheet toward the base fence.

8. The sheet processing apparatus according to claim 1, further comprising a tapping unit that taps one end of a sheet opposite to another end that faces the base fence so as to move the sheet toward the base fence.

9. An image forming system comprising:

a sheet processing apparatus that includes a correcting unit that corrects alignment of a sheet, wherein the correcting unit includes a base fence that stops an end of the sheet on an upstream side in a sheet conveying direction so that a trailing end of the sheet is aligned;

a post-processing unit that performs post-processing on the sheet after the correcting unit corrects the alignment of the sheet, wherein the post-processing unit includes a binding unit, the binding unit including a tray on which a sheet is placed;

a creasing unit that forms a crease on the sheet after the correcting unit corrects the alignment of the sheet, the creasing unit is provided in the tray; and a position setting unit that sets a position of a sheet relative to the creasing unit, wherein the creasing unit performs a creasing process after the position setting unit sets the position, wherein the position setting unit includes a moving unit that moves the creasing unit in a direction parallel to the tray and sets the creasing unit at a position where a sheet is to be creased; and an image forming apparatus that forms an image on the sheet.

* * * * *